US006729278B2

(12) United States Patent
Hammoud

(10) Patent No.: US 6,729,278 B2
(45) Date of Patent: May 4, 2004

(54) DUAL COIL, DUAL LIFT ELECTROMECHANICAL VALVE ACTUATOR

(75) Inventor: Mazen Hammoud, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/065,238

(22) Filed: Sep. 27, 2002

(65) Prior Publication Data

US 2004/0060528 A1 Apr. 1, 2004

(51) Int. Cl.[7] ..... F01L 9/04
(52) U.S. Cl. ..... 123/90.11
(58) Field of Search ..... 123/90.11; 251/129.01, 251/129.02, 129.15, 129.16

(56) References Cited

U.S. PATENT DOCUMENTS

| | | | | |
|---|---|---|---|---|
| 4,375,793 A | | 3/1983 | Seilly et al. | 123/90.11 |
| 4,455,543 A | | 6/1984 | Pischinger et al. | 335/266 |
| 4,660,871 A | | 4/1987 | Arakawa et al. | 292/81 |
| 4,777,915 A | | 10/1988 | Bonvallet | 123/90.11 |
| 4,792,165 A | | 12/1988 | Nishimura | 292/19 |
| 5,044,563 A | | 9/1991 | Mesenich | 239/585 |
| 5,222,714 A | | 6/1993 | Morinigo et al. | 251/129.16 |
| 5,498,039 A | | 3/1996 | Bivens | 292/145 |
| 5,647,311 A | | 7/1997 | Liang et al. | 123/90.11 |
| 5,692,463 A | | 12/1997 | Liang et al. | 123/90.11 |
| 5,704,314 A | * | 1/1998 | Allmendinger et al. | 123/90.11 |
| 5,758,830 A | | 6/1998 | Kim | 239/585.5 |
| 5,765,513 A | | 6/1998 | Diehl et al. | 123/90.11 |
| 5,979,376 A | * | 11/1999 | Hatano et al. | 123/90.11 |
| 6,047,672 A | * | 4/2000 | Hanai et al. | 123/90.11 |
| 6,047,673 A | | 4/2000 | Lohse et al. | 123/90.11 |
| 6,085,704 A | | 7/2000 | Hara | 123/90.11 |
| 6,182,621 B1 | | 2/2001 | Salber et al. | 123/90.15 |
| 6,257,182 B1 | * | 7/2001 | Hara et al. | 123/90.11 |
| 6,414,406 B1 | * | 7/2002 | Ikoma et al. | 310/30 |
| 6,572,074 B2 | * | 6/2003 | Yang et al. | 251/54 |

FOREIGN PATENT DOCUMENTS

| | | |
|---|---|---|
| DK | 38671 | 4/1928 |

* cited by examiner

*Primary Examiner*—Thomas Denion
*Assistant Examiner*—Ching Chang

(57) ABSTRACT

A dual coil, dual lift electromechanical valve actuator (10) that provides a closed valve position (P1), first high lift position (P2), and second low lift position (P3) wherein the second low lift position of the valve (20) is maintained without the need for supply of electrical current to the actuator.

21 Claims, 5 Drawing Sheets

| BRAKE MEAN EFFECTIVE PRESSURE (BAR) | | | | | | | | | |
|---|---|---|---|---|---|---|---|---|---|
| 10 | 1 | 1 | 1 | 1 | 1 | 1 | 1 | 1 | 1 |
| 8 | 1 | 1 | 1 | 1 | 1 | 1 | 1 | 1 | 1 |
| 5 | 1 | 1 | 1 | 1 | 1 | 1 | 1 | 1 | 1 |
| 7 | 1 | 1 | 1 | 1 | 1 | 1 | 1 | 1 | 1 |
| 6 | 1 | 1 | 1 | 1 | 1 | 1 | 1 | 1 | 1 |
| 5 | 1 | 1 | 1 | 1 | 1 | 1 | 1 | 1 | 1 |
| 4 | 0.1 | 0.1 | 1 | 1 | 1 | 1 | 1 | 1 | 1 |
| 3.5 | 0 | 0 | 0.1 | 1 | 1 | 1 | 1 | 1 | 1 |
| 3 | 0 | 0 | 0 | 0.1 | 1 | 1 | 1 | 1 | 1 |
| 2.5 | 0 | 0 | 0 | 0 | 0.1 | 1 | 1 | 1 | 1 |
| 2 | 0 | 0 | 0 | 0 | 0 | 0.1 | 1 | 1 | 1 |
| 1.5 | 0 | 0 | 0 | 0 | 0 | 0.1 | 0.1 | 1 | 1 |
| 1 | 0 | 0 | 0 | 0 | 0 | 0 | 0 | 1 | 1 |
| | 600 | 1000 | 1500 | 2000 | 2500 | 3000 | 3500 | 4000 | 5000 |
| RPM | | | | | | | | | |

FIG. 5

DUAL COIL, DUAL LIFT ELECTROMECHANICAL VALVE ACTUATOR

BACKGROUND OF INVENTION

1. Field of the Invention

The present invention relates to electromechanically actuated valves, such as intake and exhaust valves of an internal combustion engine, and to electromechanical actuators therefore.

2. Description of Related Art

Electromechanically actuated valves have been developed for use as intake and exhaust valves for internal combustion engines. Such electromechanically actuated intake and exhaust valves are mounted on the engine cylinder head to provide variable valve timing that offers the opportunity to better control and operate the internal combustion engine.

A so-called constant or single lift electromechanical valve actuator includes first (upper) and second (lower) electromagnets between which an armature disk on a valve-actuating shaft resides for movement between the electromagnets. The actuator is mounted on the cylinder head above the conventional intake or exhaust valve, valve closing spring, and valve retainer in such a manner that the valve-actuating shaft of the actuator engages an end of the valve stem to actuate the valve. The upper electromagnet is energized to close the valve and the lower electromagnet is energized to open the valve with valve lift being equal to the distance between the bottom of the armature disk and the top of the lower electromagnet where valve travel stops. Movement of the valve has been guided by first and second valve stem guides that are fixed in position in the respective first and second electromagnets and a conventional valve guide fixed in position in the cylinder head. Engines equipped with constant lift electromechanically actuated intake and exhaust valves typically have a constant lift optimized for maximum torque and power. However, such engines suffer from poor combustion stability at light engine loads as a result of very low in-cylinder air-fuel mixture turbulence at such loads and also suffer from poor noise-vibration-harshness (NVH) due to high air dynamics noise.

Attempts have been made to develop so-called dual lift electromechanically actuated intake and exhaust valves that provide variable valve timing and variable lift to provide higher in-cylinder air-fuel mixture turbulence at light engine load and high gas flow at high engine load. One type of dual lift electromechanically actuated valve includes the aforementioned first and second electromagnets and the armature disk therebetween to move and hold the valve at a first lift position (full open valve position) relative to the valve closed position and an additional third electromagnet and second armature disk connected to the valve stem in a manner to move and hold the valve at a second lift position (mid-open valve position) relative to the closed valve position. Each electromagnet must remain energized to hold the valve at the respective closed, full open, and mid-open valve position during engine operation. U.S. Pat. Nos. 5,647,311; 5,692,463; and 5,765,513 describe such dual lift electromechanically actuated valves.

SUMMARY OF INVENTION

The present invention provides a dual coil, dual lift electromechanical valve actuator that provides a closed valve position, first high lift position, and second low lift position wherein the second low lift position of the valve is maintained without the need for supply of electrical current to the actuator.

In an illustrative embodiment of the invention, the actuator comprises a movable valve-actuating shaft for actuating the valve. The valve-actuating shaft may be engaged end-to-end with a valve stem of the valve or may be integral with the valve stem. The actuator includes a first valve-closing electromagnet and a second valve-opening electromagnet spaced apart along a length of the valve-actuating shaft with an armature of the valve-actuating shaft disposed between the first and second electromagnets. To change from high to low valve lift operation, the armature is moved by energization of the first electromagnet to a first armature position that establishes the valve closed position and by energization of the second electromagnet to a second armature position that establishes the first high lift position of the valve relative to a valve seat. The actuator further includes a tubular guide member which receives the valve-actuating shaft and which is movable relative thereto to a location between the first and second electromagnets to define a third armature position where the armature resides on the guide member when the first and second electromagnets are de-energized to establish the second low lift position relative to the valve seat. The guide member is retained at the location with a mechanical latch, while a valve closing spring force and valve opening spring force are provided to hold the valve at the second low lift position while the first and second valve closing electromagnets are de-energized. The valve thereby is maintained at the second low lift position without the need for electrical current to be supplied to the actuator.

The above advantages of the present invention will become more readily apparent from the following description taken with the following drawings.

BRIEF DESCRIPTION OF DRAWINGS

FIG. 5 is a calibration table having output values of 0 or 1 depending on the valve lift mode function as a function engine speed and engine load.

DETAILED DESCRIPTION

Figure 1:
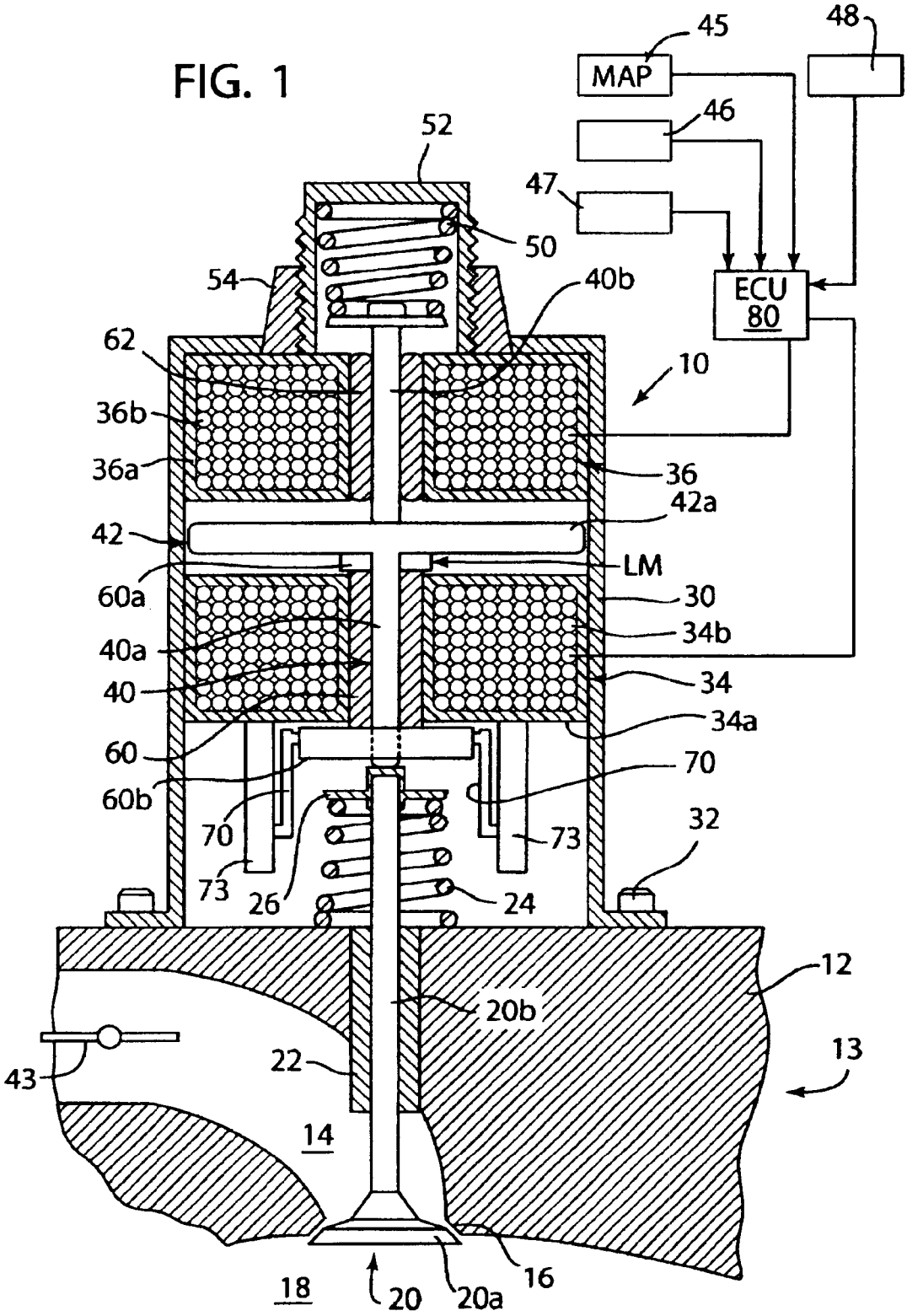
FIG. 1 is a schematic sectional view of an engine cylinder head including a dual coil, dual lift electromechanical actuator and a valve shown in a second low lift position pursuant to an illustrative embodiment of the invention.

The present invention provides a dual coil, dual lift electromechanical valve actuator for movably actuating a valve. Although the invention is described below and shown in the drawings with respect to an intake valve or exhaust valve of an internal combustion engine, the invention is not so limited since the electromechanical actuator can be used to actuate any reciprocating element having two or more discrete, different positions.

Referring to FIG. 1, a dual coil, dual lift electromechanical actuator 10 pursuant to an embodiment of the invention is shown disposed on a conventional cylinder head 12 of an internal combustion engine 13. The engine cylinder head 12 includes an intake or exhaust port 14 and a valve seat 16.

An engine valve 20 is disposed in the port 14 to control flow of gases into or out of a combustion chamber 18. That is, engine valve 20 can comprise an intake valve or an exhaust valve as the case may be. The valve 20 includes a valve head 20*a* that seats against the valve seat 16 when the valve 20 is in the valve closed position and a stem 20*b*. The valve stem 20*b* is slidably received in a fixed tubular valve guide member 22 disposed in the cylinder head 12. The valve stem 20*b* extends outside of the cylinder head 12 and is encircled at its upper end by a valve closing coil spring 24 held in position on the cylinder head by a retainer cap 26 in conventional manner.

Figure 3A:
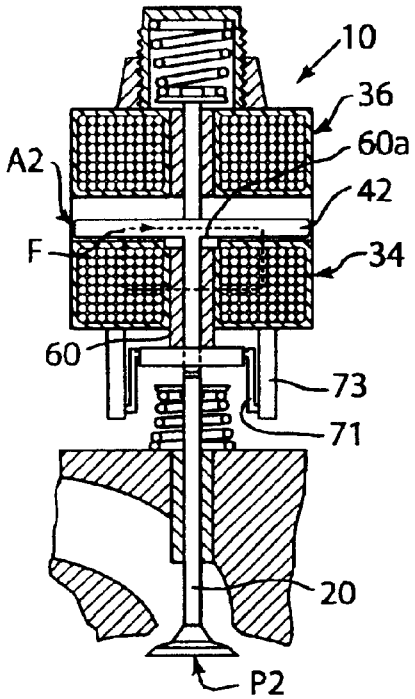
FIGS. 3A through 3F are schematic sectional views of the electromechanical actuator sans the housing and the engine cylinder head showing positions of the valve at a first high (full open) lift position, at a closed position, at a second low (mid-open) lift position, and back at a closed position.
Figure 3B:
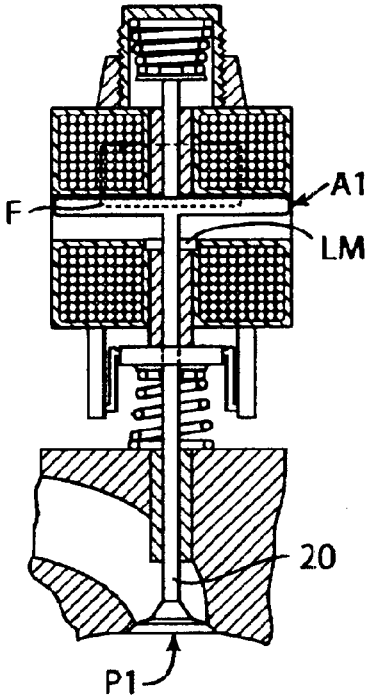
Figure 3C:
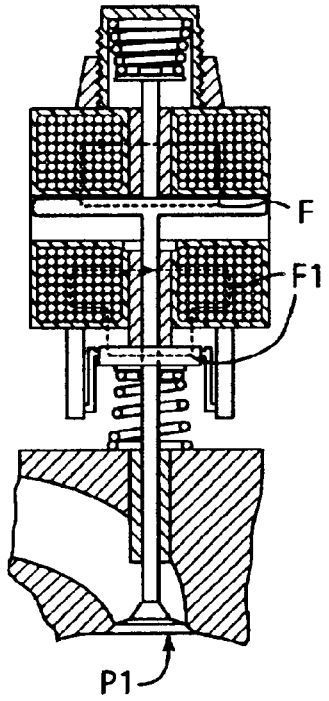
Figure 3D:
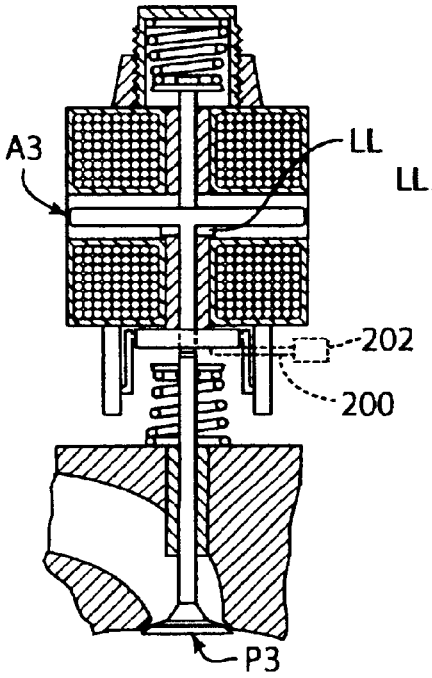
Figure 3E:
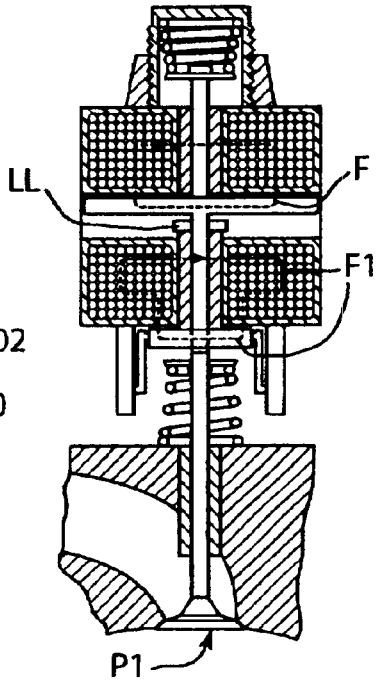
Figure 3F:
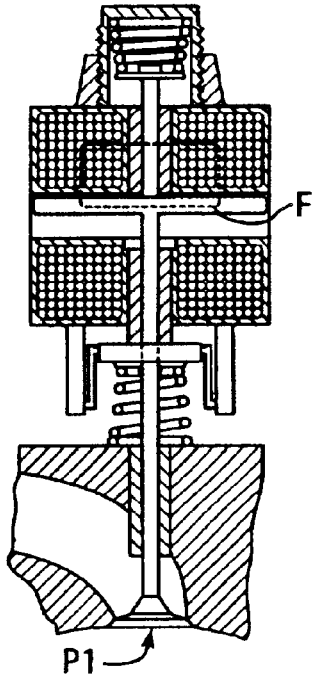
Figure 4:
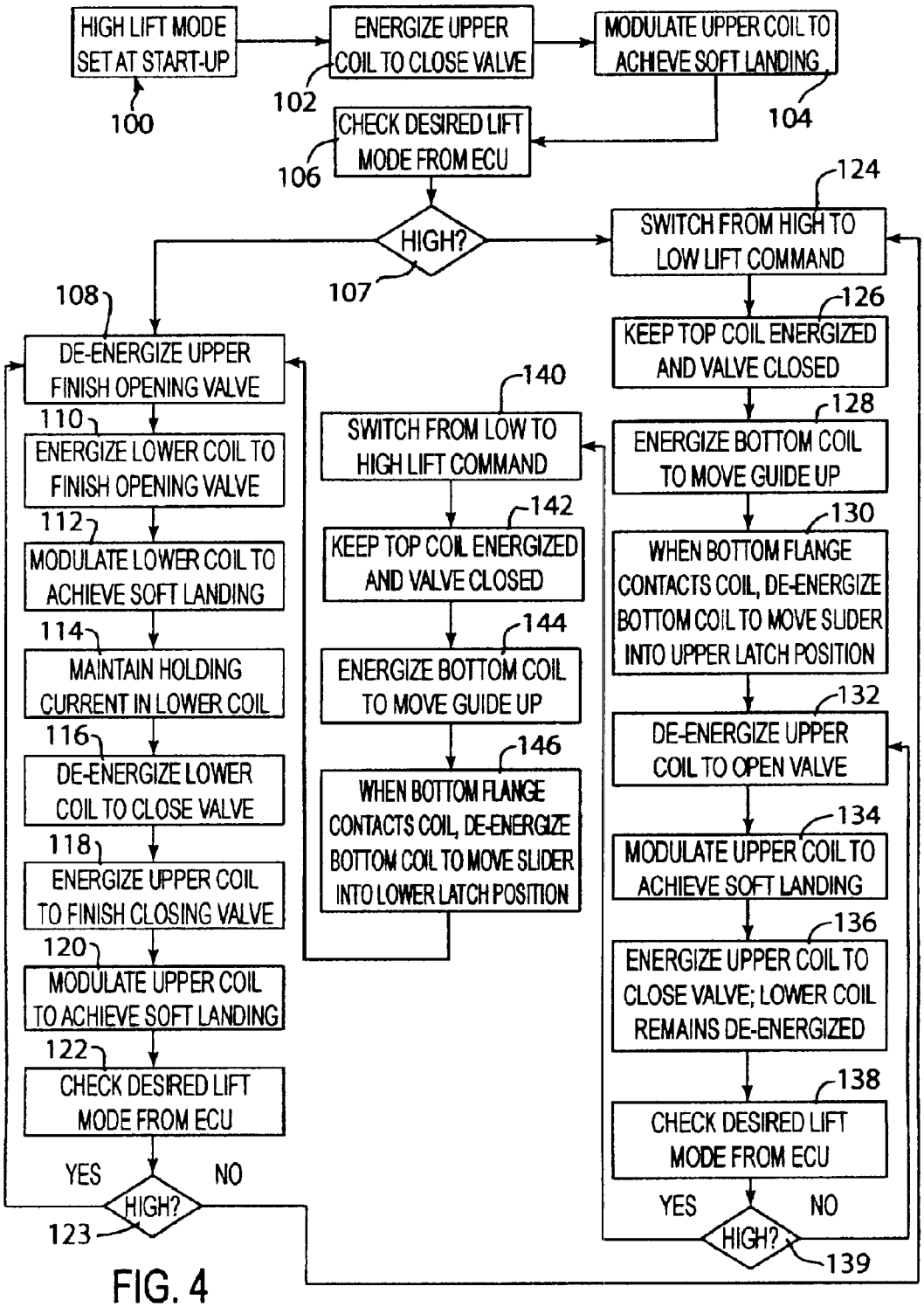
FIG. 4 is a diagram of engine control system logic for controlling the electromechanical actuator.

The dual coil, dual lift electromechanical actuator 10 is disposed on the engine cylinder head 12 to actuate or drive the valve 20 to move among a valve closed position P1 (FIGS. 3B and 3E) and two discrete lift positions relative to valve seat 16; i.e. a valve high (full open) lift position P2 (FIG. 3A) and valve low (mid-open) lift position P3 (FIGS. 1 and 3D). In particular, the actuator 10 includes a housing 30 that is mounted on the cylinder head 12 using fasteners 32. A first valve opening electromagnet 34 and a second valve closing electromagnet 36 are disposed in the housing 30 about and spaced apart along a length of a movable valve-actuating shaft 40. Electromagnet 34 includes a magnetically permeable (e.g. steel) outer core 34*a* surrounding an electromagnetic wire coil 34*b* therein. Similarly, electromagnet 36 includes a magnetically permeable (e.g. steel) outer core 36*a* surrounding an electromagnetic wire coil 36*b*. Wire coils 34*b*, 36*b* are connected to a electronic engine control unit ECU 80 that supplies electrical current signals to the coils 34*b*, 36*b* in a manner to actuate the engine valve 20 among the valve closed position P1, first high lift position P2, and second low lift position P3.

The electromechanical actuator 10 includes the movable valve-actuating shaft 40 for actuating the valve 20. The valve-actuating shaft 40 is coaxially aligned with the valve 20. If the valve-actuating shaft 40 is separate from the valve 20, it is coaxially aligned with the longitudinal axis thereof and engaged axially end-to-end with end cap 26 on valve stem 20*b*. Alternately, the valve-actuating shaft 40 may be connected by a suitable coupling to the end of the valve stem 20*b* itself. Still further, the valve-actuating shaft 40 can be formed integrally as part of the valve stem 20*b*.

The valve-actuating shaft 40 includes lower and upper shaft sections 40*a*, 40*b* abutted against one another to facilitate assembly of the actuator 10. Alternately, the valve-actuating shaft 40 can be a one piece shaft. The lower (or upper) section 40*a* of the shaft 40 includes an armature 42 in the form a flat disk 42*a* disposed in the axial space between the first and second electromagnets 34, 36. The armature disk 42*a* can be made of magnetically permeable material such as iron based material and fastened to the shaft 40 by friction welding or other fastening technique.

The valve-actuating shaft section 40*a* abuts a valve opening coil spring 50 that exerts a biasing action on shaft 40 in a direction opposing the force of the valve closing spring 24. The preload of valve opening spring 50 can be adjusted by threadable adjustment of cap 52 relative to threaded collar 54 fixedly attached on the housing 30.

The valve-actuating shaft sections 40*a*, 40*b* are shown received in respective first and second tubular guide members 60, 62 of the respective first and second electromagnets 34, 36. The guide members 60, 62 guide axial motion of the shaft sections 40*a*, 40*b* within the respective electromagnets 34, 36. The guide member 62 in the second electromagnet 36 can be fixed in position in core 34*a* by interference fit.

Pursuant to an embodiment of the invention, the guide member 60 in the first electromagnet 34 is movable relative thereto and to the valve-actuating shaft 40. The movable guide member 60 includes a laterally extending, non-magnetically permeable flange 60*a* (e.g. made of copper) at an upper end thereof and an annular armature 60*b* in the form of an armature disk at an opposite end from flange 60*a* and disposed below the first electromagnet 34. The armature disk 60*b* can be made of magnetically permeable material such as iron based material and fastened to the guide member 60 by friction welding or other fastening technique.

Figure 2:
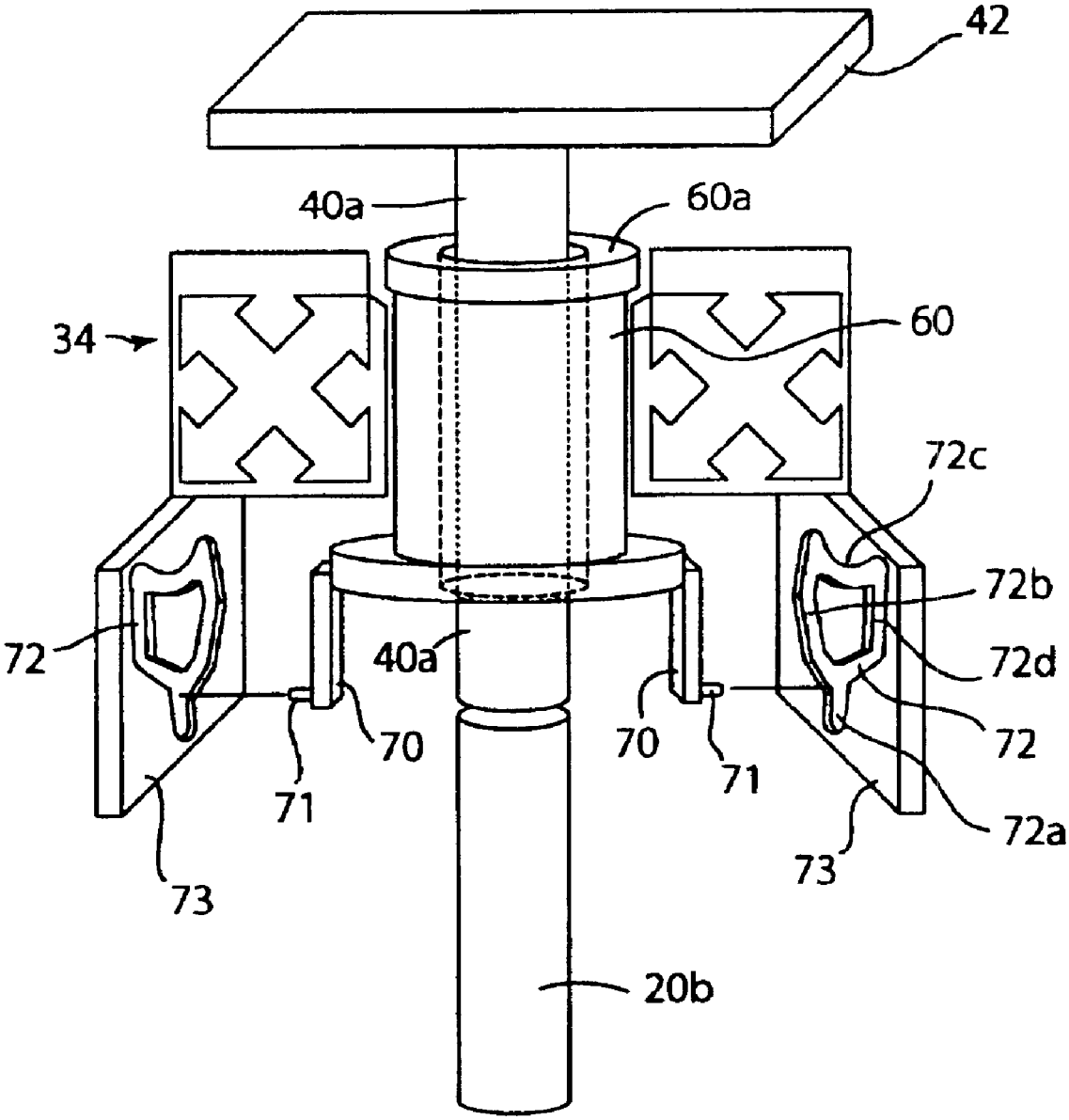
FIG. 2 is a schematic exploded view of the dual coil, dual lift electromechanical actuator without the housing.

Referring to FIGS. 1 and 2, the movable guide member 60 also includes first and second latch sliders 70 connected to diametrically opposite sides of armature disk 60*b* for movement with the guide member. The latch sliders each include a radially extending pin 71. Each pin 71 is received in a guide channel 72 of a respective latch guide 73 machined or cast into the bottom of the housing of the first electromagnet 34. Each guide channel includes a lowermost latch region 72*a*, an ascending region 72*b*, an upper latch region 72*c*, and a descending region 72*d*. The pin 71 of each latch slider 70 moves in channel 72 as the guide member 60 is moved upward or downward in FIGS. 1–2. Each pin 71 is hinged on the guide member 60 so that it can move freely in channels 72 as it ascends and descends. The guide member 60 can move downwardly from a location where flange 60*a* is at location LL relatively remote from electromagnet 34 between electromagnets 34, 36 to a location LM proximate electromagnet 34 under the effect of gravity as optionally assisted by an optional low tension spring (not shown).

Each channel 72 includes the lower latch region 72*a* where the respective latch pin 71 is retained against downward movement when the guide member 60 is at its lower position shown in FIG. 3A within the first electromagnet 34. Each channel 72 also includes the upper latch region 72*c* where the respective latch pin 71 is retained against downward movement when the guide member flange 60*a* is moved to a location LL between the first and second electromagnets 34, 36 as described below and shown in FIG. 3D. The latch sliders 70 and respective latch guides 73 thereby comprise means for retaining the guide member 60 with flange 60*a* at the location LL when the first and second electromagnet 34, 36 are de-energized and also retaining the guide member 60 at its lower location LM proximate the first electromagnet 34.

The electromechanical valve actuator 10 is controlled by an engine electronic control unit 80. The ECU 80 controls, among other engine parameters and components, the open/close mode and timing of the engine valves 20, such as each intake and exhaust valve, by controlling electromechanical actuator 10 provided for each engine valve, the fuel injection amount and injection timing, the spark timing of a spark plug (not shown) associated with each combustion chamber 18, and the opening of an engine throttle 43. The ECU 80 comprises a microcomputer including a central processing unit (CPU), read-only memory (ROM), a random access memory (RAM), and a keep alive (KAM) memory, which retains information when the engine ignition key is turned-off for use when the engine is restarted, and an input/output interface (I/O interface). The ECU 80 can be embodied by an electronically programmable microprocessor, a microcontroller, an application-specific integrated circuit, or a like device to provide a predetermined engine control logic.

The ECU 80 receives a plurality of signals from the engine 10 via the input/output interface. Such signals can include, but are not limited to, signals from a manifold absolute pressure (MAP) sensor 45 which detects manifold absolute pressure, a crank angle sensor 46 which detects crank angle (and RPM) of the engine 10, an accelerator pedal depression sensor 47 which detects the amount of depression of the accelerator pedal, and a starter switch 48 which detects start-up of the engine 10.

The ECU 80 receives a plurality of signals from engine sensors via the input/output interface to enable control of the engine in desired manner. The ECU 80 processes these signals received from the engine sensors and generates corresponding signals to control engine operation, all as is well known. For example, the ECU 80 can determine a current engine operating load and speed based on signals received from the manifold absolute pressure (MAP) sensor 45 and accelerator pedal depression sensor 47 and crank angle (RPM) sensor 46. For purposes of illustration and not limitation, the ECU 80 commands the low (mid-open) intake and exhaust valve lift position P3 when the engine is operating at idle speed and up to mid-load (e.g. approximately 3.5 bar brake mean effective pressure depending upon application) and up to mid-range engine speed (approximately 2500 RPM depending on application) to improve turbulence of the air-fuel mixture in the combustion chamber 18 and to reduce NVH. However, as engine load and speed increase, the benefits of the second low (mid-open) valve lift diminish such that there is an overlap region of engine load and speed where either the valve high or low lift mode would be appropriate. A control strategy executed by ECU 80 to select between these valve lift modes is described later.

Now, the different positions of the armature 42 of the valve-actuating shaft 40 and the corresponding positions of the valve 20 are described. When the second valve closing electromagnet 36 is energized with the first valve opening electromagnet 34 de-energized and with guide member flange 60*a* at location LM proximate electromagnet 34, the armature 42 is moved to a first armature position A1, FIG. 3B, that establishes the valve closed position P1. When the first valve opening electromagnet 34 is energized with the second valve closing electromagnet 36 de-energized with the guide member flange 60*a* at location LM, the armature 42 is moved to a second armature position A2, FIG. 3A, that establishes the valve high (full open) lift position P2. The flange 60*a* of the guide member provides a stop for the armature 42 at armature position A2. To establish the second low (mid-open) lift position P3 of the valve 20, the tubular guide member 60 is moved from its location proximate electromagnet 34 to position flange 60*a* at location LL, FIG. 3D, between the first and second electromagnets 34, 36 such that its location LL defines a third armature position A3 where the armature 42 will stop on guide member flange 60*a* and reside there when the first and second electromagnets 34, 36 are de-energized. The third armature position A3 establishes the second low (mid-open) lift position of valve 20.

Operation of the electromechanical actuator 10 as controlled by ECU 80 pursuant to an illustrative control strategy is described with respect to FIGS. 3A through 3F and FIG. 4. Before engine start-up, the ECU 80 has the high lift mode set as a default setting in memory as indicated in step 100. When the starter switch 50 is activated indicating the engine is about to be started, the ECU 80 commands in step 102 energization of the coil 36*b* of electromagnet 36 to attract armature 42 to its first armature position Al and close the valve 20 against seat 16 as shown by valve position P1, FIG. 3B. The electrical current supplied to the coil 36*b* of the electromagnet 36 is modulated in step 104 to achieve a soft landing of the armature 42 against the core 36*a* at the first armature position. The valve 20 is held closed by action of the electromagnetic flux F flowing through the coil 36*b* and armature 42 and balance of forces of springs 24, 50. In step 106, immediately upon the engine being started, the ECU 80 determines whether the high lift mode or low lift mode is desired based on sensed engine load and speed at engine start-up. Typically, ECU 80 soon after engine starting commands the valve 20 to the low lift mode (position P3) to achieve a stable engine idle speed.

During normal (non-start-up) operation of the engine, the ECU determines at step 107 whether the high lift mode or low lift mode of valve 20 is desired based on sensed engine load and speed. If the high lift mode is desired, ECU 80 proceeds to step 108 where the coil 36*b* of electromagnet 36 is de-energized and step 110 where the coil 34*b* of electromagnet 34 is energized to attract armature 42 to its second armature position A2 abutted against guide member flange 60*a* at location LM and open the valve 20 to the high (full open) lift position P2. In step 112, the electrical current supplied to the coil 34*b* is modulated to achieve a soft landing of the armature 42 against the flange 62*a* of movable guide member 62. The valve 20 is held in full open position P2 by action of the electromagnetic flux F flowing through the coil 34*b* and armature 42 and balance of forces of springs 24, 50, FIG. 3A. In step 114, ECU 80 commands continued current supply to coil 36*b* to maintain the valve 20 in the high lift position P2.

In steps 116, 118, and 120, ECU 80 commands de-energization of coil 34*b* and energization of coil 36*b* to close the valve 20 against seat 16 for the purpose of sealing the combustion chamber. ECU 80 checks in steps 122, 123 whether the high lift mode is still desired. If so, ECU 80 returns and repeats steps 110 through 114.

If not, ECU 80 commands a switch from the high lift mode to the low lift mode of valve 20 as represented in step 124. In step 126, ECU 80 commands energization of coil 36*b* to keep the valve in the closed position P1 and in step 128, energization of coil 34*b* to move the guide member flange 60*a* from location LM to location LL, FIG. 3C. When coil 34*b* is energized, electromagnetic flux F1 flows preferentially through the coil 34*b* and armature 60*b* due to their proximity as compared to relative remoteness of armature 42. The electromagnetic flux does not act on flange 60*a* of guide member 60 since it is made of non-magnetically permeable material. During this upward motion of guide member 60, the pins 71 of latch sliders 70 move upwardly in ascending channel regions 72*b*. The coil 34*b* is de-energized in step 130 when the guide member armature 60*b* contacts the lower side of core 34*a*, FIG. 3D. As soon as the coil 34*b* is de-energized, the guide member 60 moves downwardly by gravity so that latch pins 71 move into upper latch region 72*c* to retain the guide member 60 with flange 60*a* at location LL between the first and second electromagnets 34, 36. In step 132, the coil 34*b* is de-energized to permit the armature 42 to move to its third armature position A3 abutted against flange 60*a* of guide member 60 at location LL and allow springs 24, 50 to move valve 20 to the low (mid-open) lift position P3 as determined by the flange 60*a* of repositioned guide member 60, FIG. 3D, when coils 34*b*, 36*b* now are both de-energized. In step 134, the electrical current supplied to the coil 36*b* is modulated to achieve a soft landing of the armature 42 against the flange 60*a* of guide member 60. When the armature 42 resides on flange 60*a* at location LL, the valve opening spring 50 is more compressed than the valve closing spring 24. The spring force balance then is sufficient to maintain the valve 20 in the mid-open position P3 without the need for any electrical current to the coil 34*b*. This saves electrical energy as compared to that required to maintain the high lift mode of operation of valve 20.

In step 136, ECU 80 commands energization of coil 36*b* while coil 34*b* remains de-energized to close the valve 20 against seat 16 to seal the combustion chamber. The coil 36*b* is energized at the current level to attract armature 42 and compress spring 50. This closing action is possible since the position of armature 42 at the third armature position A3 is within the range of the electromagnetic force of the coil 36*b*. The electrical current to coil 36*b* is modulated to provide a soft landing of armature 42 against core 36*a*. ECU 80 checks in steps 138, 139 whether the high lift mode is desired.

If not, ECU 80 returns and repeats steps 126 through 134 to achieve the low lift mode of operation of valve 20.

If the high lift mode is desired, ECU 80 commands a switch from the low lift mode to the high lift mode of valve 20 as represented in step 140. In step 142, ECU 80 commands energization of coil 36*b* to keep the valve in the closed position P1 and in member armature 60*b* contacts the lower side of core 34*a*, FIG. 3D. As soon as the coil 34*b* is de-energized, the guide member 60 moves downwardly by gravity so that latch pins 71 move into upper latch region 72*c* to retain the guide member 60 with flange 60*a* at location LL between the first and second electromagnets 34, 36. In step 132, the coil 36*b* is de-energized to permit the armature 42 to move to its third armature position A3 abutted against flange 60*a* of guide member 60 at location LL and allow springs 24, 50 to move valve 20 to the low (mid-open) lift position P3 as determined by the flange 60*a* of repositioned guide member 60, FIG. 3D, when coils 34*b*, 36*b* now are both de-energized. In step 134, the electrical current supplied to the coil 36*b* is modulated to achieve a soft landing of the armature 42 against the flange 60*a* of guide member 60. When the armature 42 resides on flange 60*a* at location LL, the valve opening spring 50 is more compressed than the valve closing spring 24. The spring force balance then is sufficient to maintain the valve 20 in the mid-open position P3 without the need for any electrical current to the coil 34*b*. This saves electrical energy as compared to that required to maintain the high lift mode of operation of valve 20.

Although the use of latch sliders 70 and latch guides 73 has been described to retain the guide member 60 with flange 60*a* at locations LM and LL, the invention is not so limited and can practiced using other retaining means to retain the guide member 60. For example, as illustrated in dashed lines in FIG. 3D, a solenoid-actuated pin 200 can be moved by a solenoid 202 to a position under the guide member 60 when flange 60*a* is at location LL to retain the guide member in lieu of the latch sliders 70 and latch guides 73. The pin 200 would be moved under the guide member 60 with flange 60*a* at location LL during the low lift mode of operation. The pin 200 would be withdrawn by its solenoid 202 out from under the guide member 60 to allow it to return by gravity as assisted by optional low tension spring (not shown), to the location where flange 60*a* is at location LM during high mode of operation. The solenoid 202 can be mounted on actuator housing 30 so that pin 200 extends between the latch guides 73 and can be controlled by ECU 80.

Moreover, the latch sliders 70 and latch guides 73 can be eliminated by moving the guide member 60 to location LL using fluid pressure (e.g. hydraulically), rather than by energization of electromagnet 34. For example, the guide member 60 can comprise two guide member sections that move relative to one another with a seal between the sections. Hydraulic pressure can be applied between the sections to expand the guide member sections apart to move the guide member flange 60*a* on the upper section to location LL, while the lower section remains stationary. The hydraulic pressure is kept constant (locked) to retain the guide member flange at location LL during the low lift mode of operation of valve 20. The hydraulic pressure is released to sump to return the guide member flange by gravity as assisted by an optional spring to location LM during the high lift mode of operation of valve 20.

While the invention has been described in terms of specific embodiments thereof, it is not intended to be limited thereto but rather only as set forth in the appended claims.

What is claimed is:

1. A dual lift electromechanical actuator for a valve, comprising:

a movable valve-actuating shaft for actuating said valve, a first valve-closing electromagnet and a second valve-opening electromagnet spaced apart along a length of said valve-actuating shaft, said valve-actuating shaft having an armature disposed between said first electromagnet and said second electromagnet, said armature being moved by energization of said first electromagnet to a first armature position that establishes a valve closed position and by energization of said second electromagnet to a second armature position that establishes a first lift position of said valve, and a tubular guide member which receives said valve-actuating shaft and which is movable relative thereto to a location between said first electromagnet and said second electromagnet to define a third armature position where said armature resides on said guide member when said first electromagnet and said second electromagnet are de-energized, said third armature position establishing a second lift position of said valve.

2. The actuator of claim 1 including means for retaining said guide member at said location when said first electromagnet and second electromagnet are de-energized.

3. The actuator of claim 2 wherein said means comprises a latch slider connected to said guide member and a latch guide in which said latch slider moves and is held at a latched position when said guide member is at said location.

4. The actuator of claim 1 including a valve opening spring that provides an opening force on said valve opposing a closing force of a valve closing spring in a manner to maintain said valve at said second lift position while said first valve opening electromagnet and said second valve closing electromagnet are de-energized.

5. The actuator of claim 2 wherein said means comprises a solenoid actuated plunger moved to engage said guide member in a manner to retain said guide member at said location.

6. The actuator of claim 1 wherein said guide member includes a laterally extending flange at an end thereof, said armature of said valve-actuating shaft residing on said flange when said armature is at said third armature position.

7. The actuator of claim 1 wherein said guide member includes an armature at an opposite end from said flange and disposed below said first valve opening electromagnet.

8. The actuator of claim 7 including a latch slider connected to said armature of said guide member for movement with said guide member to said location and a latch guide in which said latch slider moves and is held at a latched position to retain said guide member at said location.

9. The actuator of claim 1 wherein said valve-actuating shaft has an end that engages an opposing end of a valve stem of said valve.

10. The actuator of claim 1 wherein said valve-actuating shaft is integral with a valve stem of said valve.

11. The actuator of claim 1 wherein said second lift position of said valve corresponds to a mid-open position of said valve relative to a full open position of said valve at said first lift position.

12. An internal combustion engine having an intake valve, a dual lift electromechanical actuator according to claim 1 for moving said intake valve among said valve closed position, said first lift position and said second lift position, and an engine control system to control energization and de-energization of said first valve opening electromagnet and said second valve closing electromagnet.

13. An internal combustion engine having an exhaust valve of an internal combustion engine, a dual lift electromechanical actuator according to claim 1 for moving said exhaust valve among said valve closed position, said first lift position and said second lift position, and an engine control system to control energization and de-energization of said first valve opening electromagnet and said second valve closing electromagnet.

14. A method of actuating a valve, comprising:

providing a valve-actuating shaft for actuating said valve and having an armature between a first valve opening electromagnet and a second valve closing electromagnet, energizing said first electromagnet to move said armature to a first armature position that establishes a valve closed position, energizing said second electromagnet to move said armature to a second armature position that establishes a first lift position of said valve, and moving a tubular guide member in which said valve-actuating shaft is movable to a location between said first electromagnet and said second electromagnet that defines a third armature position where said armature resides on said guide member when said first electromagnet and said second electromagnet are de-energized, said third armature position establishing a second lift position of said valve.

15. The method of claim 14 wherein said guide member is moved to said location while said second valve closing electromagnet is energized to maintain said armature at said second armature position.

16. The method of claim 14 including energizing said first electromagnet to move an armature of said guide member disposed below said first electromagnet toward said first electromagnet so as to position said guide member at said location.

17. The method of claim 16 including retaining said guide member at said location, de-energizing said first electromagnet, and de-energizing said second electromagnet to permit said armature of said valve-actuating shaft to move until it resides on said guide member at said location.

18. The method of claim 17 wherein a valve closing spring force and valve opening spring force are selected to maintain said valve at said second lift position while said first electromagnet and said second electromagnet are de-energized.

19. Controlling an intake valve of an internal combustion engine to move among a closed position, a first lift position, and a second lift position using the method of claim 14.

20. Controlling an exhaust valve of an internal combustion engine to move among a closed position, a first lift position, and a second lift position using the method of claim 14.

21. The actuator of claim 1 wherein a portion of said guide member is disposed in said second valve-closing electromagnet.

* * * * *